US006752730B1

(12) United States Patent
Brine, Jr. et al.

(10) Patent No.: US 6,752,730 B1
(45) Date of Patent: Jun. 22, 2004

(54) HANDLE FOR A LACROSSE STICK

(75) Inventors: William H. Brine, Jr., Hanover, NH (US); Richard Bonanno, North Scituate, MA (US); Erik A. Brine, Bellingham, MA (US)

(73) Assignee: Brine, Inc., Milford, MA (US)

( * ) Notice: Subject to any disclaimer, the term of this patent is extended or adjusted under 35 U.S.C. 154(b) by 301 days.

(21) Appl. No.: 09/395,659

(22) Filed: Sep. 14, 1999

(51) Int. Cl.[7] ..... A63B 59/02
(52) U.S. Cl. ..... 473/513
(58) Field of Search ..... 473/560, 549, 473/550, 551, 513, 514, 302, 303, 350; 81/489

(56) References Cited

U.S. PATENT DOCUMENTS 3,702,702 A * 11/1972 Hoult ..... 473/513
5,749,798 A * 5/1998 Kuebler et al. ..... 473/549

FOREIGN PATENT DOCUMENTS

| | | | | |
|---|---|---|---|---|
| AU | 6763 | * | 4/1933 | ..... 273/81 B |
| DE | 2857022 | * | 5/1980 | ..... 473/FOR 173 |
| FR | 2403172 | * | 5/1979 | ..... 473/FOR 173 |
| GB | 187443 | * | 4/1933 | ..... 473/FOR 173 |

* cited by examiner

*Primary Examiner*—Mark S. Graham
(74) *Attorney, Agent, or Firm*—Brian M. Dingman, Esq.; Mirick, O'Connell, DeMallie & Lougee, LLP

(57) ABSTRACT

An improved handle for a lacrosse stick generally comprising a rigid elongated member, having a length and a longitudinal axis, comprising a plurality of ridges and trenches which extend along substantially the entire length of the elongated member and which are substantially parallel to the longitudinal axis.

10 Claims, 5 Drawing Sheets

HANDLE FOR A LACROSSE STICK

FIELD OF THE INVENTION

This invention relates to lacrosse sticks and more specifically to an improved handle for a lacrosse stick which inhibits a player's hands from rotating around the handle, but which does not inhibit the player's ability to adjust his or her hand position up and down the handle.

BACKGROUND OF THE INVENTION

Lacrosse stick handles are generally hollow having an octagonal cross-section along substantially the entire length of the handle, from the portion of the handle which is inserted into and attached to the lacrosse stick head, to a plastic or rubber cap at the end of the handle opposite from the head. This octagonal configuration provides improved grip over handles having a round or oval cross-section.

Although the octagonal cross-section does provide some measure of improved grip, the grip provided by the octagonal cross-section is not enough for a sport such as lacrosse. Success in the sport of lacrosse depends heavily on the player's ability to control the lacrosse stick. To maintain this control, the player must be able to cradle the stick without having his or her hands slip or rotate around the lacrosse stick, yet the player must also be able to readily adjust the position of the player's hands up and down the length of the lacrosse stick to pick a lacrosse ball up off the ground or to throw the ball.

Efforts have been made to reduce slippage during cradling maneuvers such a knurled lacrosse handle disclosed in U.S. Pat. No. 4,206,918. However, the knurled handle, although providing grip during cradling maneuvers, does not allow the player to readily move his or her hands up and down the handle. Rather the knurled handle inhibits hand movement in all directions, including up and down the handle, thereby reducing the player's ability to manipulate the lacrosse stick as needed to effectively play lacrosse. In addition, the leather gloves typically worn by lacrosse players wear quickly against the knurled handle.

SUMMARY OF THE INVENTION

It is therefore a primary object of this invention to provide a handle for a lacrosse stick with improved grip, yet which still allows a player to readily move his or her hands up and down the length of the lacrosse stick.

It is a further object of this invention to provide a handle for a lacrosse stick which inhibits a player's hands from rotating around the handle, yet which facilitates movement of the player's hands up and down the handle.

It is a further object of this invention to provide a handle for a lacrosse stick which provides improved grip during cradling maneuvers.

It is a further object of this invention to provide a handle for a lacrosse stick which facilitates movement of a player's hands up and down the length of the lacrosse stick.

It is a further object of this invention to provide a handle for a lacrosse stick which makes a player's handling maneuvers, such as cradling more efficient.

It is a further object of this invention to provide a handle with improved grip for a lacrosse stick which does not unduly wear down a player's gloves.

It is a further object of this invention to provide a handle for a lacrosse stick, the relative position of which the player can sense simply by feel.

A preferred embodiment of the handle of this invention for a lacrosse stick generally comprises, a rigid elongated member, having a length and a longitudinal axis, comprising a plurality of ridges and trenches which extend along substantially the entire length of said elongated member and which are substantially parallel to the longitudinal axis. The elongated member is preferably, generally octagonal in cross-section along a line perpendicular to the longitudinal axis.

The number and shape of the ridges and trenches may vary, although a preferred embodiment of the handle of the invention comprises eight ridges and eight trenches, wherein one or more large ridges and one or more ridges smaller than the large ridge. Specifically, the handle of this embodiment may comprise at least eight of the large ridges and at least eight of the small ridges.

Another preferred embodiment of the handle of the invention for a lacrosse stick, comprises, a hollow elongated member, comprising an exterior surface, wherein the exterior surface comprises a plurality of ridges and trenches substantially parallel to one another. The handle may further comprise an interior surface comprising a plurality of ridges and trenches. One or more of the trenches is preferably provided in a top surface of the handle and the opposing bottom surface is preferably flat.

Yet another preferred embodiment of the handle of the invention for a lacrosse stick, comprises: a hollow elongated member, comprising an exterior surface, wherein the exterior surface comprises a plurality of ridges and trenches substantially parallel to one another. The interior surface of the handle may also comprises a plurality of ridges and trenches. Similarly the elongated member may comprise a trench in the top surface and an opposing flat surface in the bottom surface of the handle. One or more of the ridges preferably has an asymmetrical profile and one or more of the trenches has tapered walls which taper outward at about a 10% draft.

Yet another preferred embodiment of the handle of the invention for a lacrosse stick comprises: an elongated member, comprising an exterior surface, wherein the exterior surface comprises a plurality of ridges and trenches substantially parallel to one another, wherein one or more of the ridges has an asymmetrical profile and wherein one or more of the trenches has tapered walls, wherein the elongated member has a top surface and a bottom surface and wherein one of the trenches is provided in the top surface and the bottom surface is flat.

This invention is the result of efforts to design a handle for a lacrosse stick which inhibits unnecessary rotation or slippage around the handle but which allows or facilitates hand movement up and down the length of the handle. The invention may be adapted to all types of lacrosse sticks and other similar devices.

BRIEF DESCRIPTION OF THE DRAWINGS

Other objects, features and advantages will occur to those skilled in the art from the following description of the preferred embodiments and the accompanying drawings in which.

DETAILED DESCRIPTION OF THE PREFERRED EMBODIMENTS

The handle of the invention for a lacrosse stick generally comprises, a rigid elongated member, having a length and a longitudinal axis, comprising a plurality of ridges and trenches which extend along substantially the entire length of the elongated member and which are substantially parallel to the longitudinal axis. The elongated member is preferably, generally octagonal in cross-section along a line perpendicular to the longitudinal axis.

Figures 1A, 1B:
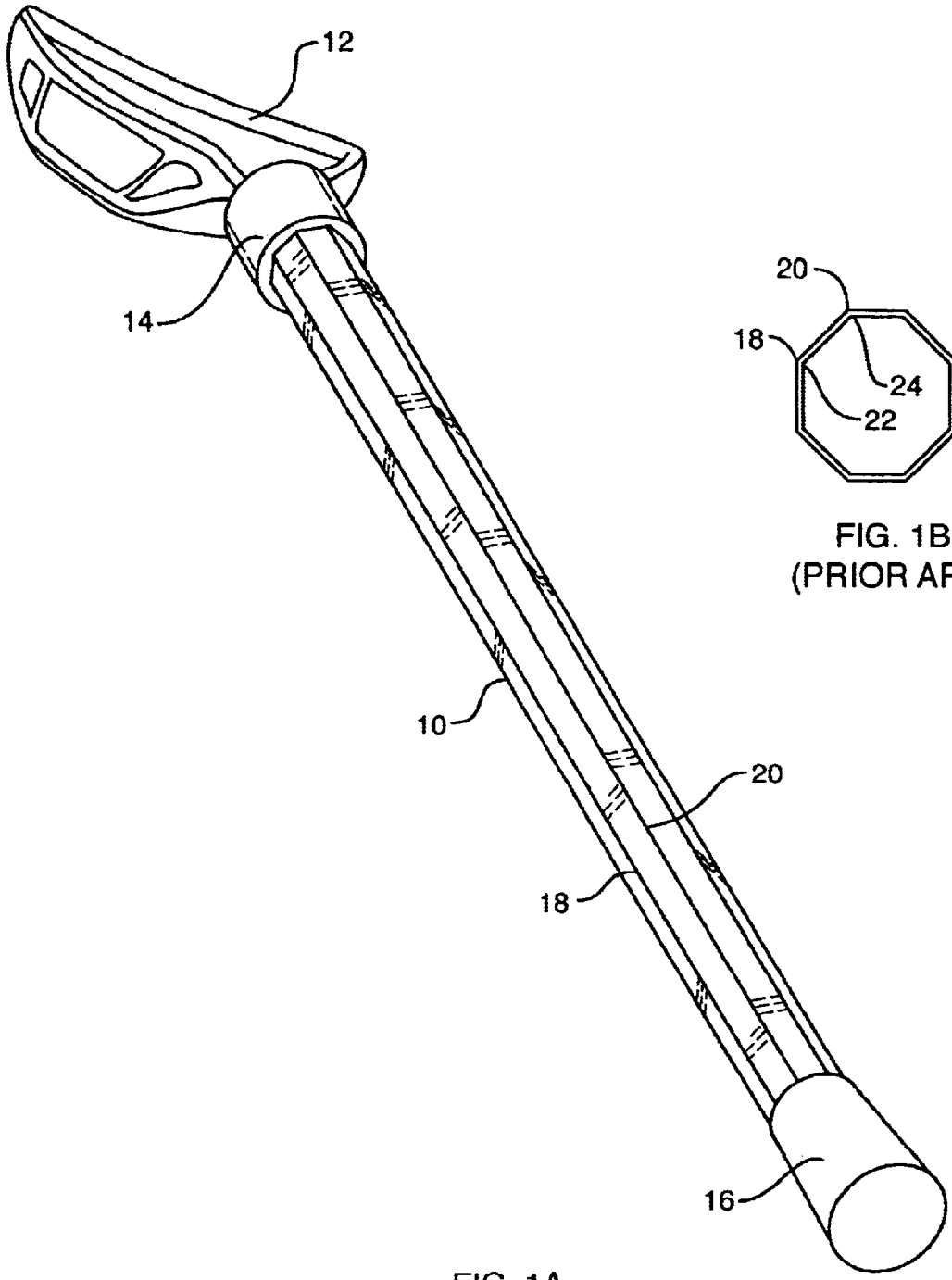
FIG. 1A (PRIOR ART)
FIG. 1B (PRIOR ART)
FIG. 1A is a perspective view of a prior art lacrosse stick comprising a prior art handle attached to a head.
FIG. 1B is a cross-sectional view of the prior art handle shown in FIG. 1A.

FIGS. 1A and 1B illustrate a prior art lacrosse stick handle generally referred to as handle 10 incorporated into a complete lacrosse stick. Handle 10 is inserted into and attached to throat 14 of lacrosse head 12. Cap 16 is provided on the distal end of handle 10 to soften the blunt end of handle 10. Handle 10 has an octagonal cross-section as shown in FIG. 1B having eight external corners, e.g. external corners 18 and 20, and eight internal corners, e.g. internal corners 22 and 24. This octagonal cross-section creates eight edges, continuous along the length of handle 10, which together form eight flat, longitudinal and contiguous surfaces along the length of handle 10 from throat 14 to cap 16. Although, the external corners of handle 10 provide some resistance to rotation during cradling and other handling maneuvers over a handle having a round or oval cross-section, the lacrosse handle of the invention greatly increases the handle's resistance to unwanted rotation during such handling maneuvers.

Figure 2A:
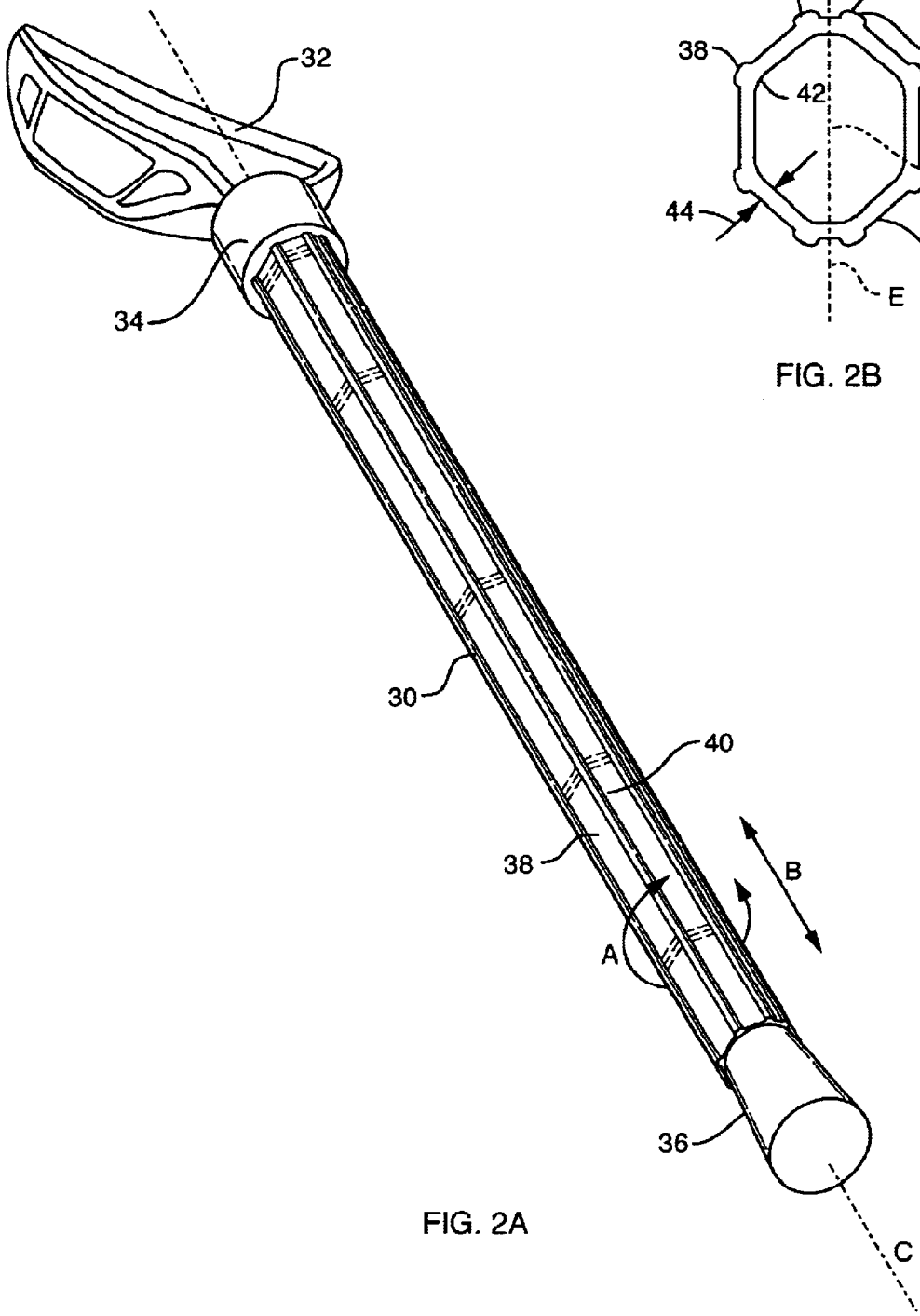
FIG. 2A is a perspective view of a preferred embodiment of the lacrosse stick handle of the invention attached to a lacrosse stick head to form a complete lacrosse stick.
Figure 2B:
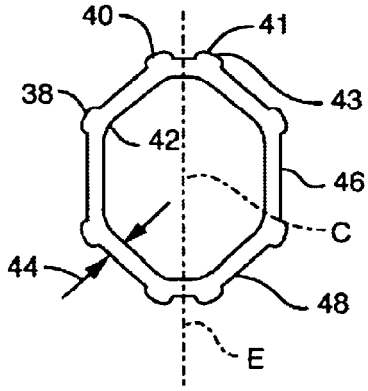
FIG. 2B is a cross-sectional view of the preferred embodiment shown in FIG. 2A.

FIGS. 2A and 2B illustrate a preferred embodiment of the handle of this invention, generally referred to as handle 30, inserted into and attached to throat 34 of lacrosse head 32. A number of suitable means for attaching handle 30 to head 32 are known in the art. Similar to prior art handle 10, cap 36 is provided on the distal end of handle 30 to soften the blunt end of handle 30. Handle 30 may be made of any material known in the art which is suited to the rigors of the game, including, but not limited to thermoplastics, lightweight metals, graphite-loaded materials or other fiber reinforced materials. Similarly, handle 30 may be made by any of the methods known in the art, including extrusion, molding, casting or machining The narrowest width of the wall of handle 30, shown as arrow 44, must, as with all embodiments of the handle of the invention, be of sufficient dimension to withstand the rigors of use, preferably about 0.05 inches.

As shown in FIG. 2B, handle 30, is generally octagonal in a cross-section along line E which is perpendicular to axis C, with gently rounded interior corners such as interior corner 42. The exterior surface of handle 30 comprises eight longitudinal ridges, e.g. ridges 38 and 40, and eight longitudinal trenches or grooves, e.g. trenches 46 and 48. The ridges have distinct edges, e.g. 41 and 43, to provide added grip. The ridges and trenches, together create a surface which inhibits hand movement around handle 30 in the direction of arrow A, yet which allows a player to move his or her hands longitudinally in the direction of arrow B. The ridges and trenches preferably extend along substantially the entire length of the handle. The term "substantially" is used to indicate that the ridges and trenches do not need to, and preferably do not, extend to the very ends of handle 30 which are inserted into throat 34 and cap 36. Furthermore, it is also envisioned that it is possible to have breaks or subtle irregularities in the ridges or trenches along the length of the handle without significantly detracting from one of the benefits of the invention, as long as these breaks or irregularities do not prevent the player from moving his or her hand position up and down handle 30 as desired during play. Likewise, the ridges and trenches are preferably substantially parallel to axis C. However, it is also envisioned that this parallelism is not absolute. The ridges and trenches need only be substantially parallel to the extent that a player is not prevented from moving his or her hands up and down the handle so as to detract from one of the benefits of the invention.

Figure 3A:
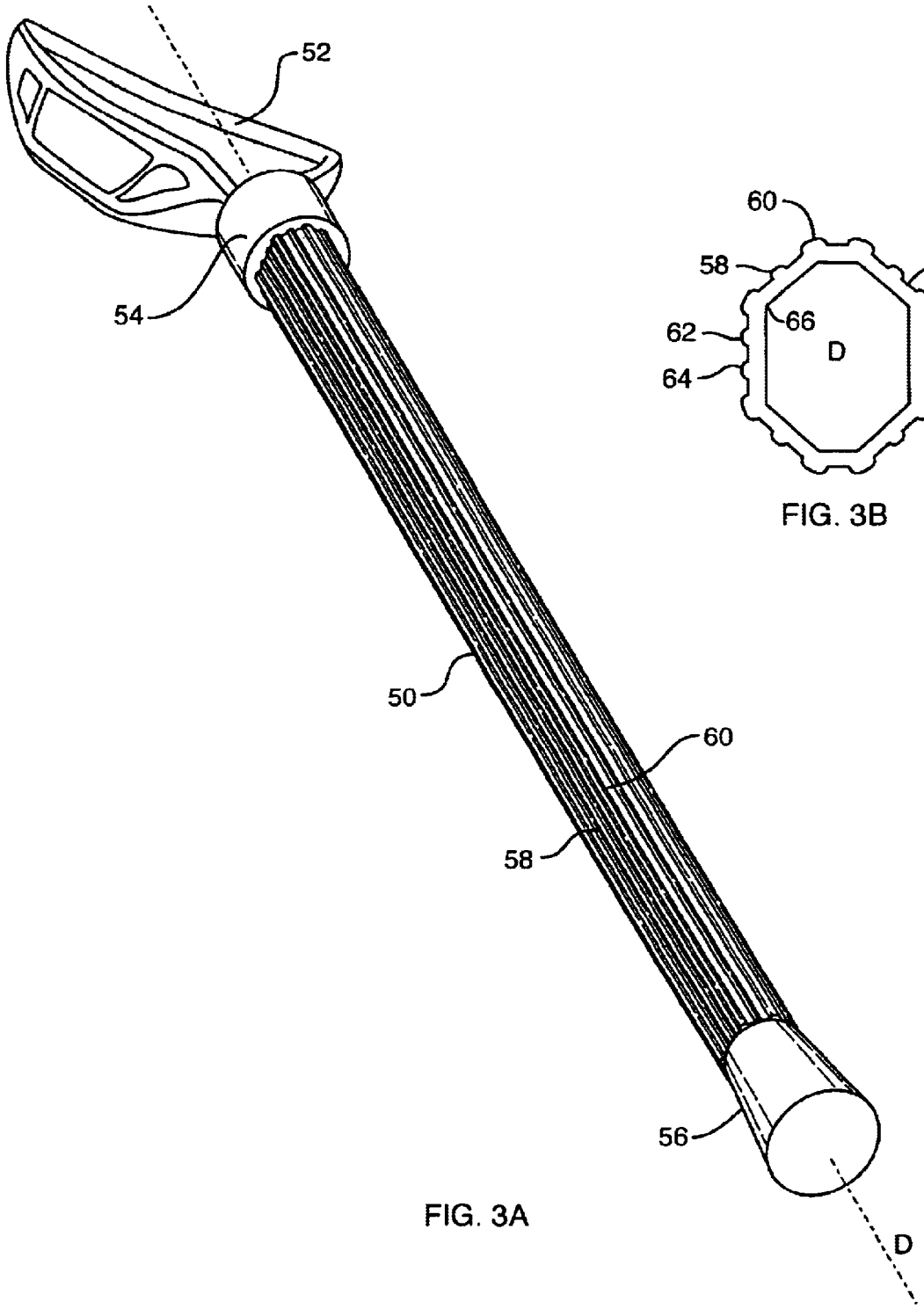
FIG. 3A is a perspective view of another preferred embodiment of the lacrosse stick handle of the invention attached to a lacrosse stick head to form a complete lacrosse stick.
Figure 3B:
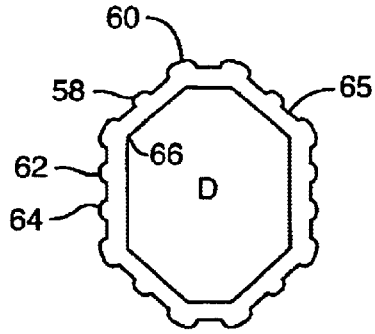
FIG. 3B is a cross-sectional view of the preferred embodiment shown in FIG. 3A.
Figure 4:
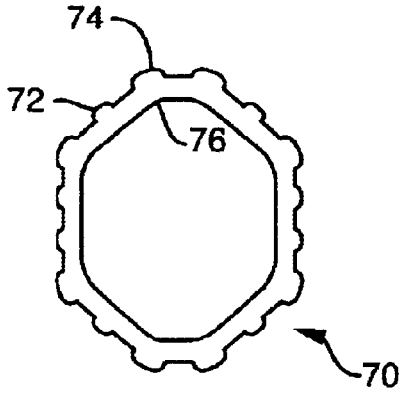
FIG. 4 is a cross-sectional view of yet another preferred embodiment of the lacrosse stick handle of the invention.
Figure 5:
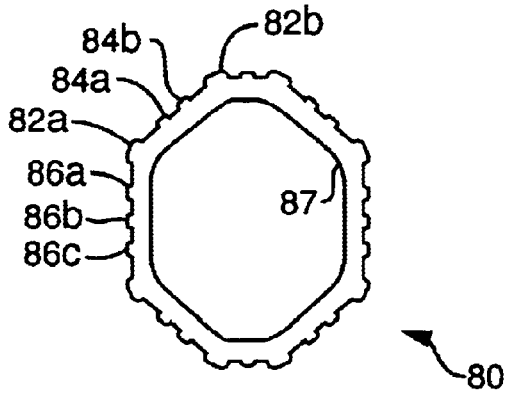
FIG. 5 is a cross-sectional view of yet another preferred embodiment of the lacrosse stick handle of the invention.
Figure 6:
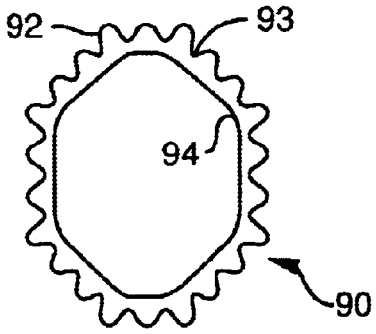
FIG. 6 is a cross-sectional view of yet another preferred embodiment of the lacrosse stick handle of the invention.
Figure 7:
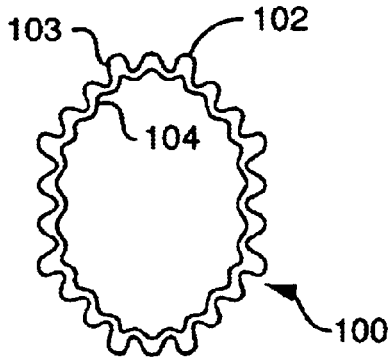
FIG. 7 is a cross-sectional view of yet another preferred embodiment of the lacrosse stick handle of the invention.
Figure 8:
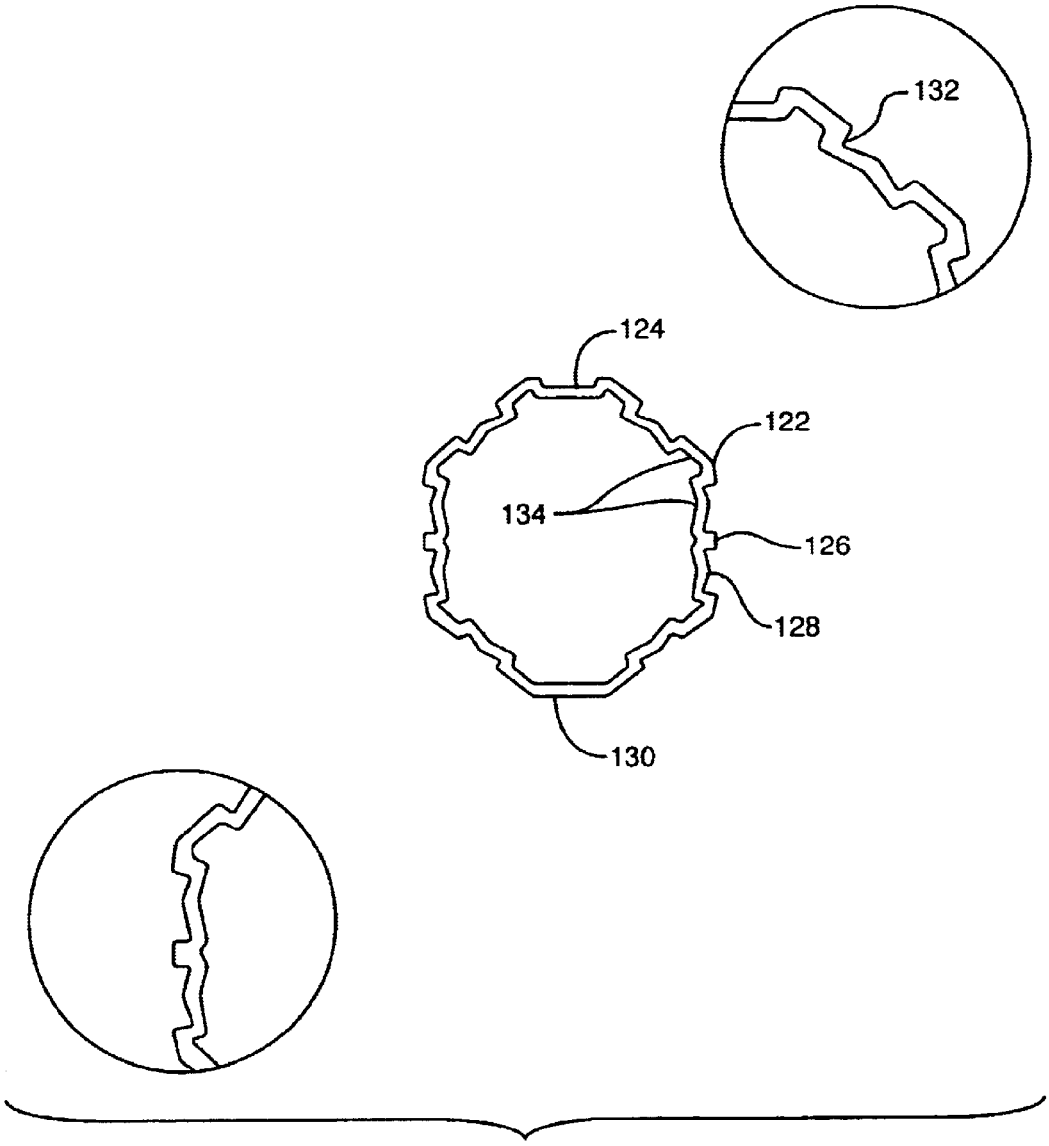
FIG. 8 is a cross-sectional view of yet another preferred embodiment of the lacrosse stick handle of the invention.

FIGS. 3A and 3B illustrate another preferred embodiment of the handle of the invention generally referred to as handle 50. Similar to handle 30, handle 50 is inserted into throat 54 of head 52 and provided with cap 56 at the end of handle 50 distal from head 52. Handle 50 also has a generally octagonal cross-section, however, the interior corners of handle 50 are pointed, e.g. interior corner 66, rather than curved. Handle 50 also differs from handle 30 in that the exterior surface of handle 50 comprises eight large longitudinal ridges, e.g. ridge 60, nine smaller longitudinal ridges, e.g. ridges 58, 62 and 64 and sixteen trenches, e.g. 65, as shown in FIG. 3B.

FIGS. 4–8 illustrate five additional preferred embodiments of the handle of the invention. Although FIGS. 4–8 only show the handles 70, 80, 90, 100 and 120 in cross-section, the ridges and trenches of each handles 70, 80, 90, 100 and 120 run along the length of the handles as do the ridges and trenches of handles 30 and 50. Handle 70 incorporates the exterior surface of handle 50 with the gently curved interior corners of handle 30. Handle 80 is similar to handle 70 but with six smaller ridges, e.g. 82*a–b* and 86*a–c*, and twenty-four trenches. Handles 90 and 100, rather than having ridges with distinct corners as in handles 30, 50, 70 and 80, have an exterior surface comprising twenty-two rounded ridges, e.g. ridges 92 and 102, and twenty-two rounded trenches, e.g. trenches 93 and 103. Handle 90 is provided with an interior surface similar to handles 30, 70 and 80 having gently curved interior corners, e.g. interior corner 94. However, handle 100 has an interior surface made up of curved ridges, e.g. ridge 106, and curved trenches, e.g. trench 104.

Handle 120 comprises asymmetrical ridges 122, smaller symmetrical ridges 126 and trenches 128. One or more of trenches 128 preferably have sidewalls with a 10% draft 132 which tapers outward from the bottom of the trenches to the top of the trenches. Trench 124 has a generally half-square profile and is provided at the top of handle 120 opposite from the bottom of handle 120 which is flat without trenches. The purpose of having a trench at the top of handle 120 but not at the bottom is to provide a player with a point of reference by which the player can determine the relative position of the lacrosse stick simply by feel. Wall F of handle 120 is typically either 0.030" or 0.050" thick but the thickness may vary depending upon the material used. The inside surface of handle 120 also comprises convolutions 134 which generally correspond to the ridges and trenches on the outer surface of handle 120.

It is envisioned that permutations of the ridges and trenches described herein may also be effective in providing the benefits of the invention. Although the ridges and trenches preferably extend along the length of the handle of the invention, one or more breaking points in the ridges and trenches along the length of the handle will not substantially detract from the benefits of the invention.

Although specific features of the invention are shown in some drawings and not others, this is for convenience only as some feature may be combined with any or all of the other features in accordance with the invention.

Other embodiments will occur to those skilled in the art and are within the following claims:

What is claimed is:

1. A lacrosse stick, comprising:

a rigid elongated member, having a length and a longitudinal axis, comprising a plurality of ridges and trenches which extend along substantially the entire length of said elongated member and which are substantially parallel to said longitudinal axis, wherein one or more of said ridges is a large ridge and one or more of said ridges is smaller than said large ridge; and a lacrosse stick head, comprising a means for fixing said rigid elongated member to said lacrosse stick head.

2. The handle for a lacrosse stick of claim 1 comprising at least eight of said large ridges and at least eight of said small ridges.

3. The handle for a lacrosse stick of claim 2, wherein at least one of said small ridges is between two of said large ridges.

4. A lacrosse stick, comprising:

a rigid elongated member, having a length and a longitudinal axis, comprising a plurality of ridges and trenches which extend along substantially the entire length of said elongated member and which are substantially parallel to said longitudinal axis, wherein said elongated member has a top surface and a bottom surface and wherein one of said trenches is provided in said top surface and said bottom surface is flat; and lacrosse stick head, comprising a means for fixing said rigid elongated member to said lacrosse stick head.

5. A lacrosse stick, comprising:

a hollow elongated member, comprising an exterior surface wherein said exterior surface comprises a plurality of ridges and trenches substantially parallel to one another, wherein said elongated member has a top surface and a bottom surface and wherein one of said trenches is provided in said top surface and said bottom surface is flat; and a lacrosse stick head, comprising a means for fixing said rigid elongated member to said lacrosse stick head.

6. A lacrosse stick, comprising:

a hollow elongated member, comprising an exterior surface, wherein said exterior surface comprises a plurality of ridges and trenches substantially parallel to one another, wherein one or more of said ridges has an asymmetrical profile; and a lacrosse stick head, comprising a means for fixing said rigid elongated member to said lacrosse stick head.

7. The handle for a lacrosse stick of claim 6 wherein one or more of said trenches has tapered walls.

8. The handle for a lacrosse stick of claim 7 wherein one or more of said trench walls tapers outward at about a 10% draft.

9. A lacrosse stick, comprising, an elongated member, comprising an exterior surface, wherein said exterior surface comprises a plurality of ridges and trenches substantially parallel to one another, wherein one or more of said ridges has an asymmetrical profile and wherein one or more of said trenches has tapered walls; and a lacrosse stick head, comprising a means for fixing said rigid elongate member to said lacrosse stick head.

10. The handle for a lacrosse stick of claim 9, wherein said elongated member has a top surface and a bottom surface and wherein one of said trenches is provided in said top surface and said bottom surface is flat.

* * * * *